United States Patent [19]

Wilmotte et al.

[11] 4,120,455

[45] Oct. 17, 1978

[54] APPARATUS FOR COOLING METAL SECTIONS

[75] Inventors: Stephan Hubert Wilmotte, Chaudfontaine; Jean Adolphe Nautet, Hony; Marios Economopoulos, Liege, all of Belgium

[73] Assignee: Centre de Recherches Metallurgiques-Centrum Voor Research In de Metallurgie, Brussels, Belgium

[21] Appl. No.: 760,579

[22] Filed: Jan. 19, 1977

[30] Foreign Application Priority Data

Jan. 23, 1976 [BE] Belgium ..... 837884
Aug. 6, 1976 [BE] Belgium ..... 845004

[51] Int. Cl.[2] ..... B22D 11/124

[52] U.S. Cl. ..... 239/429; 72/201; 164/444; 239/433; 239/550

[58] Field of Search ..... 239/429, 432, 433, 550, 239/266; 72/201; 164/89, 283 S

[56] References Cited

U.S. PATENT DOCUMENTS

| | | | |
|---|---|---|---|
| 3,347,076 | 10/1967 | Noda et al. | 72/201 |
| 3,499,456 | 3/1970 | Rerecich et al. | 164/89 X |
| 3,653,425 | 4/1972 | Elliott et al. | 164/283 S X |
| 3,727,673 | 4/1973 | Gallucci | 164/283 S X |
| 4,031,946 | 6/1977 | Marti et al. | 164/283 S X |

*Primary Examiner*—Bruce H. Stoner, Jr.
*Assistant Examiner*—Andres Kashnikow
*Attorney, Agent, or Firm*—Holman & Stern

[57] ABSTRACT

Cooling apparatus for cooling metal sections comprises a series of sprayers for simultaneously spraying a mixture of liquid and gas. Each sprayer has a gas inlet at one end and a mixture outlet at the other end. One or more liquid inlets are provided between two distinct peripheral shoulders. An elongate gas-supply manifold has outlet orifices adapted to seat the gas-inlet-side shoulders of the respective sprayers in a gas-tight manner. An elongate liquid-supply manifold has outlet orifices adapted to seat the mixture-outlet-side shoulders of the respective sprayers in a liquid-tight manner.

7 Claims, 5 Drawing Figures

FIG. 1.
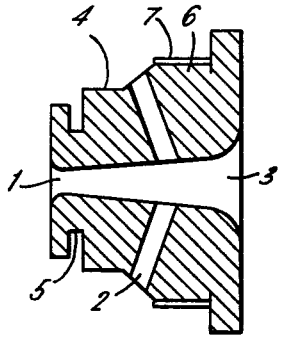
FIG. 4.
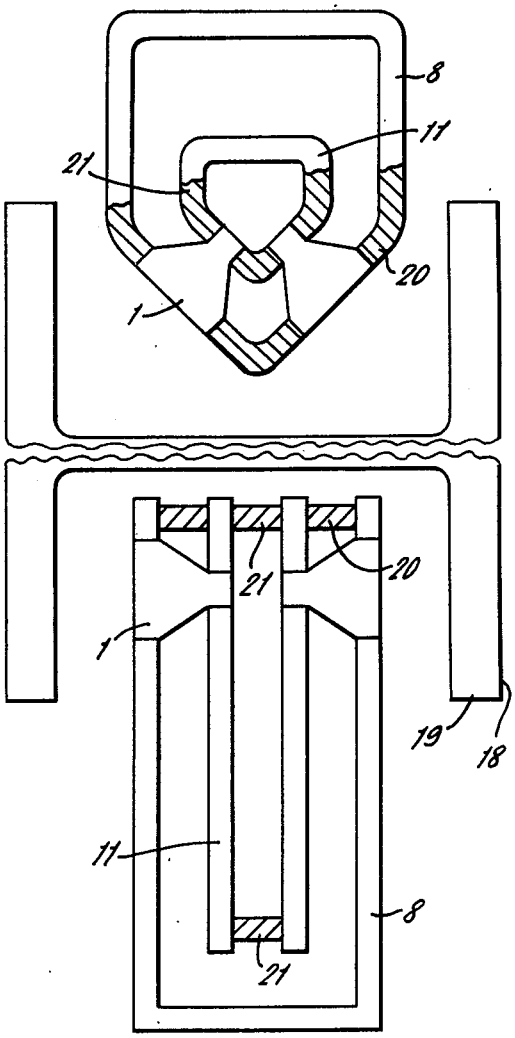
FIG. 2.
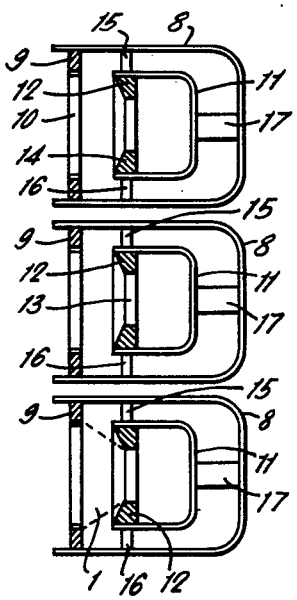
FIG. 3.

APPARATUS FOR COOLING METAL SECTIONS

The present invention relates to apparatus for cooling metal sections. The term "section" is used in this specification to include I-beams, channels, angle irons, Tees, plates, large sheets, flat bars, and strip, and generally any rolled section having at least one flat face.

Such cooling apparatus can be especially utilized at the outlet of the last finishing stand of a hot rolling mill to subject rolled products to a well-defined cooling operation, thereby giving the products a predetermined structure or characteristics. Such apparatus can also be advantageously used upstream of the finishing stands, in order to carry out thermomechanical treatment.

Cooling apparatuses, also located at the outlet of hot rolling mills, are already known. The known apparatuses comprise one or more cooling zones often having one or more series of sprayers designed to spray for example air, or water, or a mist consisting of fine droplets of water suspended in air, against sections passing past the sprayers.

The dimensions of the sections and the relatively high speed of displacement at which they may move upon emerging from the rolling mill have the consequence that the dimensions of the cooling zones are also large and the number of water and air sprayers may easily amount to several hundred per cooling zone. This state of affairs makes the construction of the cooling zones, the installation of the sprayers, the provision of multiple supplies of intended fluids, their maintenance, and their possible replacement particularly time-consuming and costly. Furthermore the cooling zones described above have not the efficiency which could be achieved with a high heat transfer coefficient. To our knowledge, the solutions proposed up to now for remedying all these drawbacks have only attained clearly insufficient results for one reason or another.

The present invention provides cooling apparatus for cooling metal sections, comprising:

(a) a series of sprayers designed to simultaneously spray liquid and gas (e.g. water and air), after they have been mixed together and possibly one has been atomized by the other, the sprayers having a gas inlet at one end, a mixture outlet at the other end, two distinct shoulders at their periphery, i.e. one shoulder at the gas inlet and the other on the mixture outlet side, and one or more liquid inlets which are disposed between the two shoulders, which are preferably circular in cross-section and coaxial with one another, each completely surrounding the sprayer;

(b) an elongate manifold designed to supply the sprayers described at (a) with gas, comprising one or more gas inlet orifices and the same number of outlet orifices as there are sprayers, the said outlet orifices being adapted to simultaneously seat, each in a gas-tight manner, on the respective gas-inlet-side of shoulders of the sprayers;

(c) an elongate manifold designed to supply the sprayers described at (a) with liquid, comprising one or more liquid inlet orifices and the same number of outlet orifices as there are sprayers, the said outlet orifices being adapted to simultaneously seat, each in a water-tight manner, on the respective liquid-outlet-side shoulders of the sprayers, the said manifold preferably completely surrounding the gas supply manifold described at (b);

(d) optionally a crossbar system for fixing the two manifolds to one another.

The two manifolds are preferably integral with one another, and the sprayers are easily installed by introducing each of them in two coaxial orifices one of which belongs to the liquid (e.g. water) manifold and the other to the gas (e.g. air) manifold, each of these two orifices being seated on a respective one of the shoulders of the sprayers. The two manifolds, as mentioned above, can be inserted one in the other, but it is alternatively possible to dispose them one on the other.

From the point of view of construction and easy assembly, it has been found to be advantageous to ensure gas-tightness on the gas-inlet-side shoulder by means of a suitable groove and joint, whereas on the outlet side gas-tightness is obtained by means of a screw-threaded connection.

The above-described apparatus has a great flexibility. It is possible to construct the cooling zones by using elements having quasi-standardized dimensions and number of rows of sprayers, and to use one or more of them depending on the dimensions and shape of the sections to be cooled. It is also easy to remove a sprayer, since it is sufficient to unscrew it to be able to replace it with another one having different dynamic characteristics. It is also possible to use a plurality of manifolds, e.g. arranged one above the other so as to obtain, by suitably choosing the relative positions of the series of sprayers, an advantageous disposition of outlets, such as a staggered disposition.

The present invention also relates to a particularly effective installation for continuously cooling metal sections emerging from hot rolling mill, the installation comprising the cooling apparatus described above.

The installation according to the present invention is particularly suitable for treating channels or I-beams emerging from the rolling mill with their web horizontal and their flanges upwards. The installation in particularly makes it possible to subject the sections to cooling so that the surface part of the flanges finally consists of tempered martensite and/or bainite, whereas their core consists of ferrite-pearlite; moreover, the core of the sections can be practically preserved from any cooling by fluid.

The installation according to the invention comprises sprayers designed to spray a gas-liquid mixture, e.g. air and water after optional atomization of one by the other, onto the section in question, the sprayers are disposed on "internal" supports preferably formed by boxes, the said supports being connected in pairs whose elements are located side by side, the outlets of the sprayers are directed so that the fluid sprayed by the sprayers fixed to one of the elements of a pair of supports is directed in a direction substantially opposite to that of the fluid sprayed by the sprayers fixed to the other element, whereby the said two sprayed fluids depart from one another.

The installation is preferably also equipped with means for moving the two elements of the same pair towards or away from one another in the same direction as that of the sprays of fluids, it is also possible to provide means for displacing the two elements in the same pair in a direction substantially perpendicular to that along which the fluids are sprayed.

The sprayers disposed on the "internal" supports ensure cooling of the internal surfaces of the flanges of the section to be treated.

To ensure more extended cooling of the section, the said installation may advantageously also comprise sprayers disposed on "external" supports, the outlets of these sprayers facing one another; the sprayers on the said external supports, arranged on either side of the internal supports, are designed to cool the external parts of the flanges of the section being treated. The installation can be equipped with means for displacing the said external supports.

An advantageous embodiment of the above-described installation comprises a plurality of successive assemblies of internal (and possibly external) supports, the said assemblies being arranged one beside the other; it also comprises a suction device located between two consecutive series of these assemblies and designed to suck cooling fluid which, after having been sprayed on the upper inner faces of the flanges of the section, is collected on the upper face of its web. The suction device may comprise a suction tube disposed above the said web, preferably at such a distance from the preceeding assembly that the calefaction layer appearing when the liquid falls onto the web is still present, which practically excludes cooling of the web by the fluid.

The suction device mentioned above preferably comprises a priming device for permanently priming the end of the suction tube, thereby considerably reducing the delay required by the suction device to start effectively sucking fluid on the web of the rolled products. If necessary, the suction device may comprise a scraper designed to confine the fluid to be removed to the zones close to the end of the suction tube and possibly to the contact zone of the latter over a certain thickness.

Advantageously in the above described installation, each of the boxes comprises a manifold of the type described above at (b), and a manifold of the type described above at (c), the sprayers in them having shoulders seating the manifolds as described at (b).

The invention will be described further, by way of example only, with reference to the accompanying drawings, which are not on scale and in which:

FIG. 1 is an axial cross-section of a sprayer;

FIG. 2 is a cross-sectional view of a series of three elements in a cooling apparatus designed to cool the outer face of one of the two flanges of a Grey-beam;

FIGS. 3 and 4 illustrate, in cross-section, two variants of a cooling apparatus adapted to cool the inner faces of the flanges of a Grey-beam.

In the drawings, the same reference numerals indicate the same parts.

Figure 5:
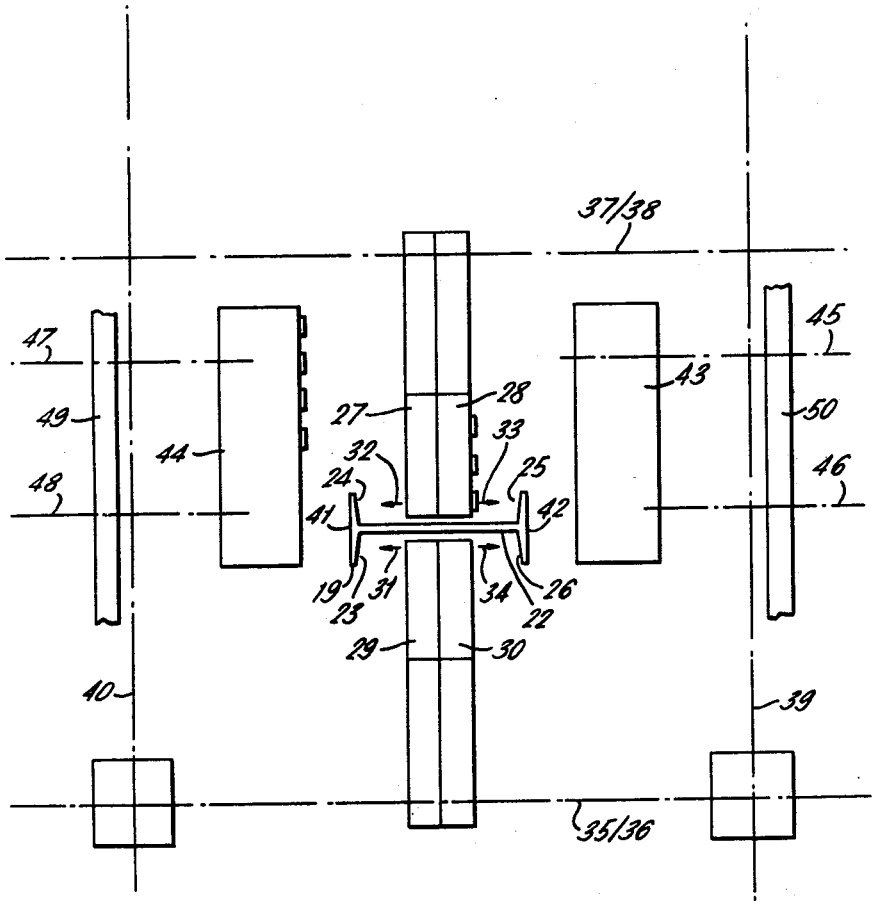
FIG. 5 is an end elevation of a cooling installation comprising cooling apparatus as illustrated in FIGS. 2 to 4.

The sprayer (FIG. 1) has an air inlet orifice 1, a water inlet orifice 2, and an outlet orifice 3 for a resulting air-water mixture. The sprayer has two coaxial cylindrical shoulders 4 and 6. The shoulder 4 is formed with a groove 5 designed to locate a sealing joint, whereas the shoulder 6 has a screw-threaded portion 7.

FIG. 2 shows a cross-sectional view of three elements of a cooling apparatus; for reasons of clarity the sprayers (as in FIG. 1) are omitted from the Figure. The length of each element is chosen according to requirements and may range, for example, from 0.5 to 3m. Each element comprises two boxes or manifolds one inside the other. The outer box supplies water to the sprayers and comprises a channel section 8 closed by a welded plate 9. The plate 9 is formed with a number of threaded openings 10 which have the same screw thread pitch as the threaded portion 7 (FIG. 1). An inner box or manifold for supplying air to the sprayers is constituted by a channel section 11 closed by a plate 12 having a number of openings 13 which are coaxial with the respective openings 10, the diameter of the openings 13 being such as to permit easy, but air-tight, location therein of the respective sprayer owing to the presence of the bevel 14. The two manifolds are locally fixed to one another by means of spacers 15 and 16 and welded crossbars 17. The two manifolds are supplied with air and water, respectively, by suitable pipes connected to the back of the manifolds. Air is supplied directly to the sprayers from the air manifolds sections 11, whereas water is supplied thereto from the water manifold sections 8, the conduits 2 communicating with the space between the plates 9 and 12.

FIGS. 3 and 4 show a cross-sectional view of apparatus similar to that described above. Such apparatus comprises sprayers 1, manifold channel-sections 8 and 11, closure plates 20 similar to the plates 9, and closure plates 21 similar to the plates 12.

FIG. 5 shows a cooling installation, including cooling apparatus as described above, cooling a steel section 19 (in this case a PN I-beam). The section 19 has its web 22 arranged horizontally and is displaced in a direction perpendicular to the plane of the drawing. The inner faces 23 to 26 of the flanges of the section 19 are exposed to coolant sprays for a given length by means of groups of sprayers 27 to 30 which spray cooling fluid in the directions of the arrows 31 to 34.

The two groups of sprayers 29 and 30 are mounted on two shafts 35, 36 whose rotation results in the groups being moved towards or away from one another depending on the direction of rotation. A similar arrangement is provided above the web 22 of the I-beam: the two groups of sprayers 27 and 28 move towards or away from one another when two shafts 37, 38 on which they are mounted are rotated. The relative vertical position of these pairs of shafts is adjusted by means of two further shafts 39, 40 which are carried by a frame (not shown) and are simultaneously rotated in the same direction of rotation by way of a system of gears. The two shafts 39, 40 have two screw-threaded portions threaded in the same direction and arranged to simultaneously rotate the shafts 37, 38 in the same direction by means of worm unit. A similar device makes it possible to synchronize the rotation of the shafts 35, 35 similarly to the shafts 37, 38.

The outer faces 41 and 42 of the flanges of the I-beam 19 are cooled by means of lateral groups of sprayers 43, 44 which can be moved towards or away from the section 19 by means of spindles 45 to 48 having screw-threaded portions disposed in worm units fixed to the frame by two crossbars 49, 50.

The number of sprayers in operation per row, the number of rows of sprayers in operation per group, and their position can be adapted to the dimensions of the product to be cooled and to its speed of displacement.

The positioning of the lateral groups of sprayers 43 and 44 can be automatically controlled, the two groups being, for example, simultaneously displaceable in opposite directions with respect to one another. It is possible to cause these movements to depend on the movement of the pairs of groups of sprayers 27, 28 and 29, 30. Mechanisms suitable for carrying out such movements are well known and are not illustrated here. It should be noted that the shafts 37, 38 may be raised independently of the shafts 35, 36, which permits easy removal of the I-beam 19.

In a particular embodiment in which the installation comprises two successive groups of sprayers, a pump is provided therebetween, equipped with suction and delivery pipes to suck water which results from the sprays of the first group of sprayers and which collects on the upper face of the I-beam web.

We claim:

1. Cooling apparatus for cooling metal sections, comprising: (a) a series of sprayers for simultaneously spraying a mixture of liquid and gas, each sprayer having a gas inlet at one end, a mixture outlet at the other end, two distinct peripheral shoulders and at least one liquid inlet between the two shoulders; (b) an elongate manifold for supplying the sprayers with gas, having outlet orifices adapted to seat the gas-inlet-side shoulders of the respective sprayers in a gas-tight manner; and (c) an elongate manifold for supplying the sprayers with liquid, having outlet orifices adapted to seat the mixture-outlet-side shoulders of the respective sprayers in a liquid-tight manner.

2. Cooling apparatus as claimed in claim 1, in which the two manifolds are rigid with one another.

3. Cooling apparatus as claimed in claim 1, in which the liquid supply manifold surrounds the gas supply manifold.

4. Cooling apparatus as claimed in claim 1, in which the shoulders are cylindrical and coaxial.

5. A cooling installation comprising apparatuses as claimed in claim 1, the installation comprising at least one pair of the said apparatuses, the mixture outlets of the sprayers of one apparatus of the pair being directed away from those of the other apparatus of the pair.

6. An installation as claimed in claim 5, further comprising means for displacing at least one of the apparatuses of the pair.

7. An installation as claimed in claim 5, comprising a series of said pairs of apparatuses.

* * * * *